US008005383B2

(12) United States Patent
Tanaka et al.

(10) Patent No.: US 8,005,383 B2
(45) Date of Patent: Aug. 23, 2011

(54) LIQUID DEVELOPER COLLECTING SYSTEM AND IMAGE FORMING APPARATUS INCLUDING THE SAME

(75) Inventors: Hiroshi Tanaka, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 12/257,236

(22) Filed: Oct. 23, 2008

(65) Prior Publication Data

US 2009/0110424 A1 Apr. 30, 2009

(30) Foreign Application Priority Data

Oct. 25, 2007 (JP) ..... 2007-277542
May 19, 2008 (JP) ..... 2008-130606

(51) Int. Cl.
*G03G 15/10* (2006.01)

(52) U.S. Cl. ..... 399/57; 399/58; 399/233; 399/237; 399/249

(58) Field of Classification Search ..... 399/57, 399/58, 233, 237, 249
See application file for complete search history.

(56) References Cited

U.S. PATENT DOCUMENTS

| | | | | |
|---|---|---|---|---|
| 5,574,548 | A * | 11/1996 | Iino et al. | 399/249 |
| 5,950,054 | A | 9/1999 | Kim | |
| 6,405,009 | B1 * | 6/2002 | Shinkawa et al. | 399/253 |
| 7,564,672 | B2 | 7/2009 | Retzlaff | |
| 7,630,671 | B2 | 12/2009 | Aruga et al. | |
| 2003/0175049 | A1 * | 9/2003 | Ichida et al. | 399/237 |
| 2007/0140738 | A1 | 6/2007 | Aruga et al. | |

FOREIGN PATENT DOCUMENTS

JP 2002-006637 1/2002

* cited by examiner

*Primary Examiner* — Ryan Walsh
(74) *Attorney, Agent, or Firm* — DLA Piper LLP (US)

(57) ABSTRACT

A liquid developer collecting system. A developing unit has a developing roller. A developing roller cleaning unit collects liquid developer on the developing roller. A concentration control unit stores liquid developer collected by the developing roller cleaning unit and controls the concentration of the liquid developer. A first feed unit feeds the liquid developer in the concentration control unit to the developing unit. A second feed unit feeds the liquid developer in the concentration control unit. A developer storage unit stores the liquid developer fed by the second feed unit.

10 Claims, 11 Drawing Sheets

LIQUID DEVELOPER COLLECTING SYSTEM AND IMAGE FORMING APPARATUS INCLUDING THE SAME

CROSS-REFERENCE TO RELATED APPLICATIONS

This application claims the benefit of priority under 35 USC 119 of Japanese patent application no. 2007-277542, filed on Oct. 25, 2007, and Japanese patent application no. 2008-130606, filed on May 19, 2008, which are incorporated herein by reference.

BACKGROUND

1. Technical Field

The present invention relates to a plurality of photosensitive bodies, a plurality of developing devices that use liquid developer containing non-volatile solvent as carrier to develop electrostatic latent images formed on the photosensitive bodies, a transfer body that sequentially transfers toner images developed by transfer units corresponding to the plural photosensitive bodies and stacks the toner images, a liquid developer collecting system that controls the concentration of liquid developer collected from the developing devices and reuses the liquid developer, and also relates to an image forming apparatus including these components.

2. Related Art

Various types of wet-type image forming apparatus that develop a latent image using high-viscosity liquid developer containing toner formed by solid components and dispersed in liquid solvent to visualize an electrostatic latent image have been proposed. The liquid developer used in a typical wet-type image forming apparatus contains solid components (toner particles) suspended in electricity-insulation organic solvent (carrier) such as silicon oil, mineral oil, and edible oil. The particle diameter of the toner particles may be as small as about 1 μm. By using such fine toner particles, the wet-type image forming apparatus can produce higher quality images than those produced by a dry-type image forming apparatus that uses powder toner particles having particle diameter of about 7 μm.

An image forming apparatus of this type that reuses liquid developer collected from developing device or photosensitive body has been proposed. According to such an image forming apparatus in the related art, a thin layer of liquid developer having a thickness of 1 to 50 μm is applied to a developing roller, and sent to a developing nip. The liquid developer that passes the developing nip and remains on the developing roller is scraped by a blade and stored in a collection section. Then, solid particles of the collected liquid developer are shifted onto the photosensitive body, where the liquid developer is diluted. The carrier rate of the liquid developer collected from the photosensitive body is high, and thus the solid concentration of the liquid developer is lower than that of the liquid developer collected from the developing device.

The diluted liquid developer is sent to a concentration control unit by using a pump or the like. Then, the diluted developer is mixed with a high-concentration liquid toner supplied thereto to adjust the concentration of the developer to a target solid concentration. The liquid developer having the target solid concentration is again sent to the developing device and reused (see JP-A-2002-6637).

However, the proportion of the solid particles in the collected liquid developer is not constant. Typically, the consumption amount of the solid particles varies according to image data. For example, when the image data corresponds to full-tone, many solid particles contained in the liquid developer collected from the developing roller after development by using a developing roller cleaning blade are shifted to the photosensitive body and consumed. Thus, the solid concentration of the collected liquid developer is lowered. When the image data corresponds to half-tone, a smaller amount of the solid particles are shifted to the photosensitive body, and the solid concentration of the collected liquid developer thus changes little. Thus, the solid concentration needs to be adjusted to a target concentration by using a concentration control device when the solid concentration is equal to or lower than an allowable predetermined value in case of reuse of the collected liquid developer whose solid concentration varies. In a color image forming apparatus, the concentration control device of the collected liquid developer is provided for each color so as to prevent color mixture. In order to meet demand for size reduction of the image forming apparatus, the capacity of the concentration control device provided for each color needs to be reduced.

In order to adjust a low concentration of collected liquid developer to a predetermined concentration by using a concentration control device having a small capacity, high-concentration new toner is supplied to the concentration control device from a toner tank. The concentration of the new toner may be, for example, about 35%. Thus, for example, when the concentration of the collected liquid developer is 17% under a condition of a predetermined concentration set at 20%, a predetermined amount of the new toner having the concentration of 35% needs to be supplied by the concentration control device to adjust to the predetermined concentration. In this case, the concentration cannot be efficiently adjusted when the concentration control device does not have sufficient vacant capacity.

SUMMARY

It is an advantage of some aspects of the invention to provide a liquid developer collecting system having a simple structure and that efficiently controls the concentration of liquid developer collected with high efficiency, and an image forming apparatus including this collecting system.

A liquid developer collecting system according to a first aspect of the invention includes: a developing unit that has a developing roller; a developing roller cleaning unit that collects liquid developer on the developing roller; a concentration control unit that stores liquid developer collected by the developing roller cleaning unit and controls the concentration of the liquid developer; a first feed unit that feeds the liquid developer in the concentration control unit to the developing unit; a second feed unit that feeds the liquid developer in the concentration control unit; and a developer storage unit that stores the liquid developer fed by the second feed unit. According to this structure, the capacity of the concentration control unit used for concentration control is secured, and the collected liquid developer is efficiently reused.

The liquid developer collecting system may further include a switching unit that switches between the first feed unit and the second feed unit for feeding the liquid developer in the concentration control unit. According to this structure, the capacity of the concentration control unit used for concentration control is secured, and the collected liquid developer is efficiently reused.

The liquid developer collecting system, the developing unit may have a storage section that supplies liquid developer to the developing roller and a collection section into which the liquid developer collected from the developing roller flows, wherein the storage section and the collection section are sectioned by a partition wall. In this case, the liquid developer may overflow the partition wall from the storage section into the collection section. According to this structure, the amount of liquid developer supplied to the storage section is set slightly larger than the liquid developer consumption amount required for development. Thus, no loss of developer is produced by collecting and reusing the overflowed liquid developer.

The liquid developer collecting system may further include a photosensitive body; a squeeze unit that collects liquid developer on the photosensitive body; and a third feed unit that feeds the liquid developer collected by the squeeze unit to the concentration control unit. According to this structure, liquid developer having a high proportion of carrier on the photosensitive body can be reused with no loss of developer.

The liquid developer collecting system may further include a concentration sensor disposed in the concentration control unit; a liquid level sensor disposed in the concentration control unit; and a calculating unit that calculates the feed amount of the liquid developer from the concentration control unit to the developer storage unit based on measurement data of the concentration sensor and the liquid level sensor. According to this structure, concentration control for reusing the collected liquid developer is efficiently performed.

The liquid developer collecting system may further include a fourth feed unit that feeds the liquid developer in the developer storage unit to the concentration control unit. According to this structure, the collected liquid developer can be reused with no loss of developer.

In the liquid developer collecting system, the developer storage unit may be a liquid disposal tank. According to this structure, the developer storage unit provided for each color is provided as a common liquid disposal tank. Thus, the space required for disposing components is reduced.

An image forming apparatus according to a second aspect of the invention includes: a photosensitive body that carries an electrostatic latent image; a developing device that develops the electrostatic latent image by liquid developer to form an image; a transfer unit that transfers the image on the photosensitive body; a developing unit that has a developing roller; a developing roller cleaning unit that collects liquid developer on the developing roller; a concentration control unit that stores liquid developer collected by the developing roller cleaning unit and controls the concentration of the liquid developer; a first feed unit that feeds the liquid developer in the concentration control unit to the developing unit; a second feed unit that feeds the liquid developer in the concentration control unit; and a developer storage unit that stores the liquid developer fed by the second feed unit. According to this structure, the capacity of the concentration control unit used for concentration control is secured, and collected liquid developer is efficiently reused.

The image forming apparatus may further include a switching unit that switches between the first feed unit and the second feed unit for feeding the liquid developer in the concentration control unit. According to this structure, the capacity of the concentration control unit used for concentration control is secured, and the collected liquid developer is efficiently reused.

In the image forming apparatus, the developing unit may have a storage section that supplies liquid developer to the developing roller and a collection section into which the liquid developer collected from the developing roller flows, wherein the storage section and the collection section are sectioned by a partition wall. In this case, the liquid developer may overflow the partition wall from the storage section into the collection section. According to this structure, the amount of liquid developer supplied to the storage section is set slightly larger than the liquid developer consumption amount required for development. Thus, no loss of developer is produced by collecting and reusing the overflowed liquid developer.

The image forming apparatus may further include a squeeze unit that collects liquid developer on the photosensitive body, and a third feed unit that feeds the liquid developer collected by the squeeze unit to the concentration control unit. According to this structure, a liquid developer having a high proportion of carrier on the photosensitive body can be reused with no loss of developer.

The image forming apparatus may further include a concentration sensor disposed in the concentration control unit, a liquid level sensor disposed in the concentration control unit, and a calculating unit that calculates the feed amount of the liquid developer from the concentration control unit to the developer storage unit based on measurement data of the concentration sensor and the liquid level sensor. According to this structure, concentration control for reusing the collected liquid developer is efficiently performed.

The image forming apparatus may further include a fourth feed unit that feeds the liquid developer in the developer storage unit to the concentration control unit. According to this structure, the collected liquid developer can be reused with no loss of developer.

In the image forming apparatus, the developer storage unit may be a liquid disposal tank. According to this structure, the developer storage unit provided for each color is provided as a common liquid disposal tank. Thus, the space required for disposing components is reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
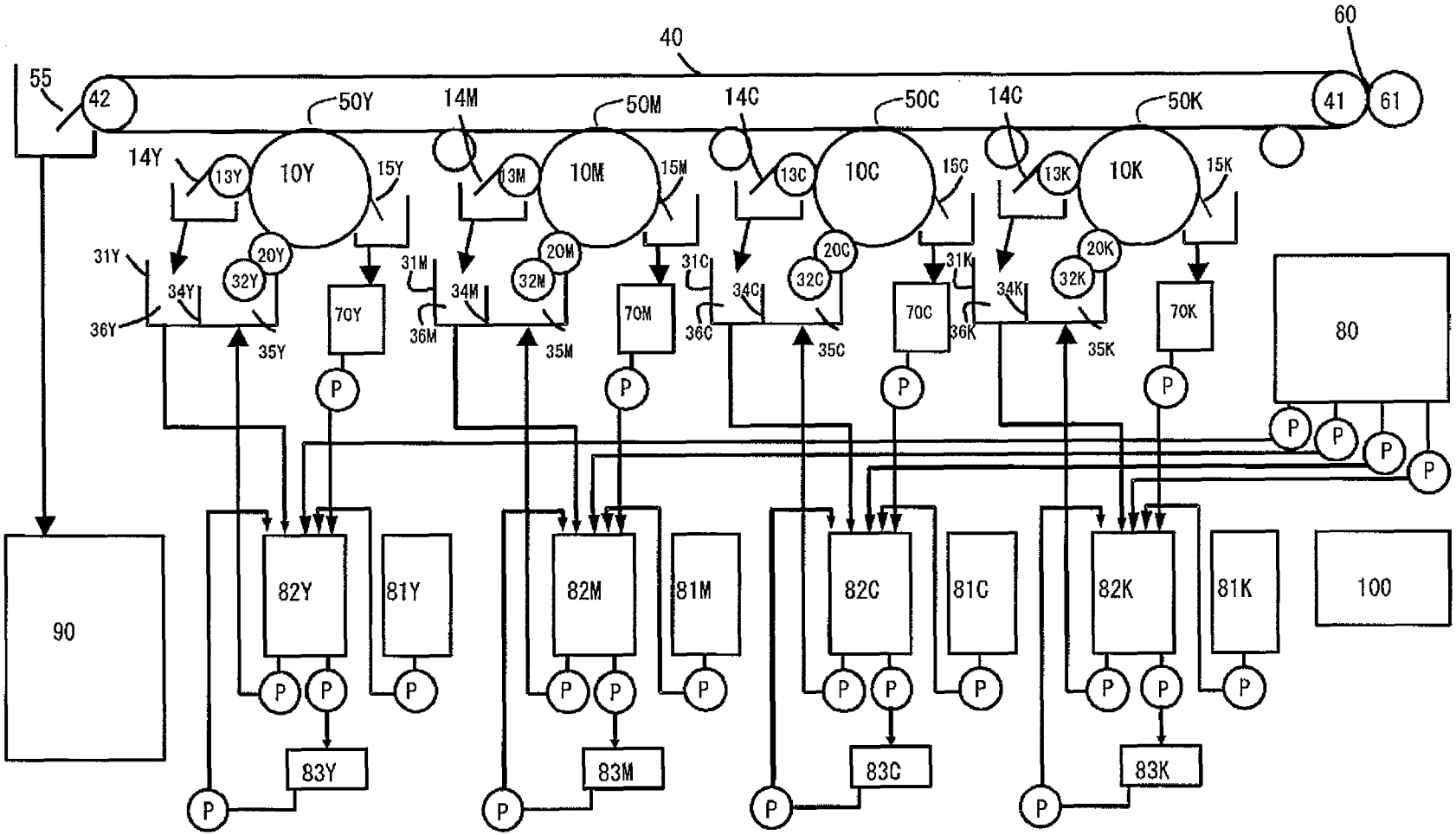
FIG. 1 illustrates an image forming apparatus that includes a liquid developer collecting system according to an embodiment of the invention.
Figure 2:
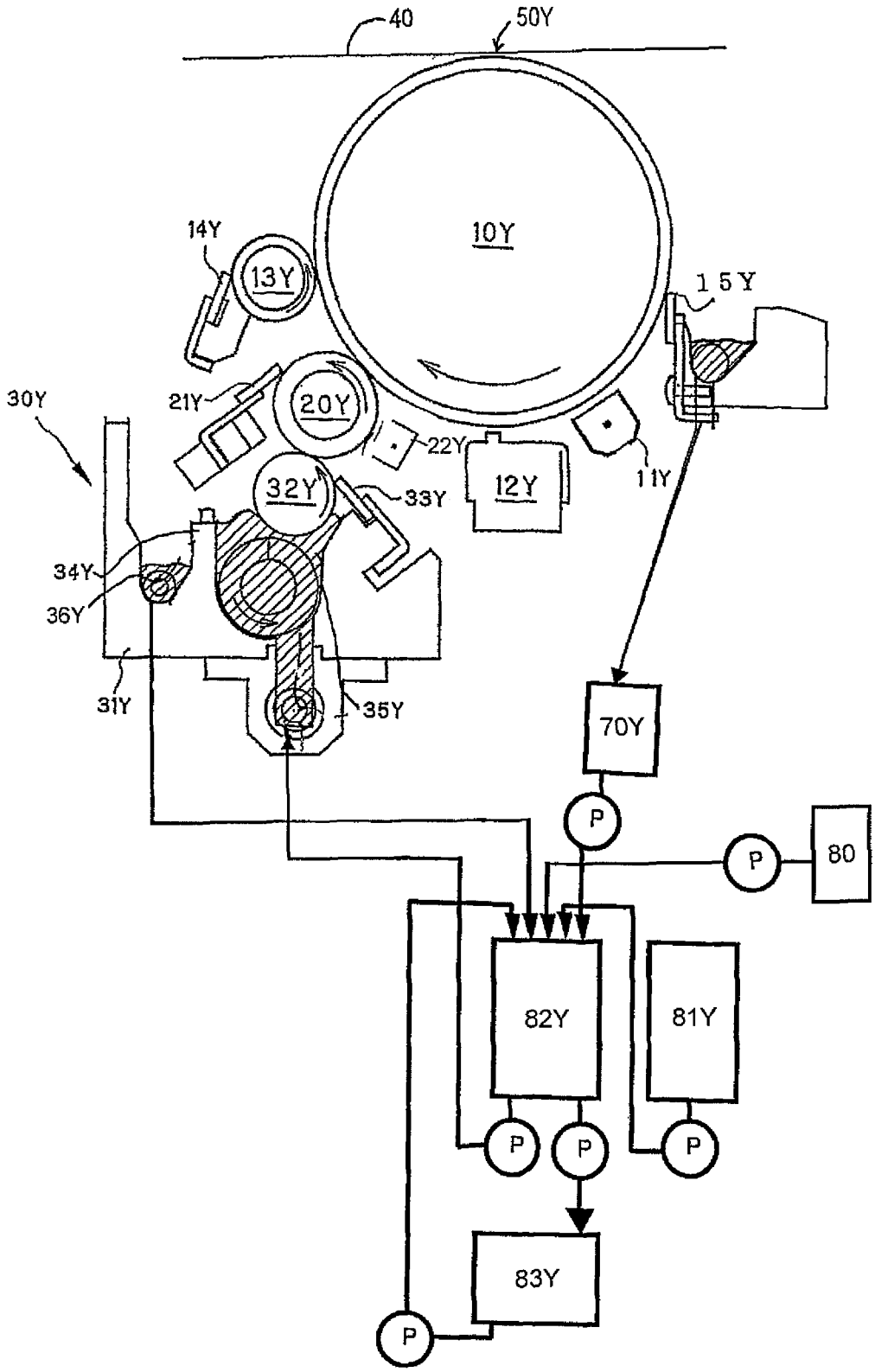
FIG. 2 is an enlarged view of a portion of the image forming apparatus of FIG. 1.

Embodiments of the invention are now described with reference to the drawings. FIG. 1 illustrates the main structure elements of an image forming apparatus 1 that includes a liquid developer collecting system according to a first embodiment of the invention. In FIG. 1, Y, M, C and K representing yellow (Y), magenta (M), cyan (C) and black (K) are added to each reference number given to the same structure element. FIG. 2 is an enlarged view of a portion of image forming apparatus 1 that shows the structure of an image forming section, a developing unit, an intermediate transfer body, and the liquid developer collecting system for yellow (Y).

As illustrated in FIG. 1, image forming apparatus 1 includes photosensitive bodies 10Y, 10M, 10C and 10K as latent image carrier bodies for yellow (Y), magenta (M), cyan (C) and black (K) disposed in tandem. The photosensitive bodies 10Y, 10M, 10C, and 10K represent a yellow photosensitive body, a magenta photosensitive body, a cyan photosensitive body, and a black photosensitive body, respectively. Each photosensitive body is constituted by a photosensitive body drum and may have an endless belt shape.

As can be seen from FIG. 2, the image forming section includes a corona electrifier 11Y, an exposure unit 12Y, a developing roller 20Y, a photosensitive body squeeze roller 13Y, and a photosensitive body cleaning blade 15Y in the rotation direction (shift direction) of the outer circumference of the photosensitive body 10Y. The photosensitive body squeeze roller 13Y faces and contacts the photosensitive body 10Y between a developing roller 20Y and a primary transfer unit 50Y. The photosensitive body squeeze roller 13Y has a squeeze roller cleaning blade 14Y that slidingly contacts and presses the surface of the photosensitive body squeeze roller 13Y.

A developing roller cleaning blade 21Y disposed downstream from a developing nip contacts the outer circumference of the developing roller 20Y, and a developer supply roller 32Y using an anilox roller disposed upstream from the developing nip contacts the outer circumference of the developing roller 20Y. A regulating blade 33Y for regulating the developer supply amount contacts the developer supply roller 32Y. A corona electrifier 22Y for electrifying toner is disposed between the developing nip and the developer supply roller 32Y. The developer supply roller 32Y is contained in a developer container (toner reservoir) 31Y containing the liquid developer. A primary transfer roller (not shown) of a primary transfer unit SOY is disposed at a position opposed to the photosensitive body 10Y with an intermediate transfer body 40 interposed between the primary transfer roller and the photosensitive body 10Y. An intermediate transfer body cleaning blade 55 is disposed on the intermediate transfer body 40.

Toner of the liquid developer contained in the developer container 31Y may include particles having an average particle diameter of 1 μm, for example, with colorant such as known pigment dispersed in known thermoplastic resin. The liquid carrier may be insulation liquid carrier such as Isopar (trademarked product of Exxon Co.) in case of low-viscosity concentration liquid developer. On the other hand, the liquid carrier may be organic solvent; silicon oil having a flash point of 210° C. or higher such as phenylmethyl siloxane, dimethyl polysiloxane, and polydimethyl siloxane; mineral oil, aliphatic saturated hydrocarbon having a boiling point of 170° C. or higher and relatively low viscosity such as 3 mPa·s at 40° C. such as liquid paraffin; normal paraffin; vegetable oil; edible oil; higher fatty acid ester; or another insulation liquid carrier in the case of a high-viscosity concentration liquid developer. For forming liquid developers 23Y, 23M, 23C and 23K, toner particles are added to the liquid carrier with dispersant, and the toner solid concentration is set at about 20%.

In the image forming section and the developing unit, the photosensitive body 10Y is uniformly electrified by the corona electrifier 11Y, and an electrostatic latent image is formed on the electrified photosensitive body 10Y by applying a laser beam modulated according to an inputted image signal by using the exposure unit 12Y having an optical system such as a semiconductor laser, polygon mirror, and F-θ lens.

Then, the electrostatic latent image formed on the photosensitive body 10Y is developed by supplying liquid developer to the developing roller 20Y from the developer container 31Y as one of the developer containers containing the liquid developers in the respective colors (yellow in this example) via the developer supply roller 32Y while regulating the supply developer amount by using the regulating blade 33Y. The photosensitive body squeeze roller 13Y contacts the photosensitive body 10Y on which the electrostatic latent image has been developed by the developing roller 20Y to remove excessive carrier. The squeeze roller cleaning blade 14Y contacts the photosensitive body squeeze roller 13Y to collect the liquid developer removed from the photosensitive body 10Y and feed the liquid developer to a liquid developer reuse unit to be described later. The photosensitive body squeeze roller 13Y is a conductive elastic roller having an elastic member such as conductive urethane rubber and a fluororesin surface layer on the surface of a metal core.

The intermediate transfer body 40 is an endless belt component wound around a driving roller 41 and following roller 42, and is rotated by the driving roller 41 while contacting the photosensitive bodies 10Y, 10M, 10C and 10K in the primary transfer units 50Y, 50M, 50C and 50K. The primary transfer rollers (not shown) of the primary transfer units 50Y, 50M, 50C and 50K are opposed to the photosensitive bodies 10Y, 10M, 10C and 10K with the intermediate transfer body 40 interposed therebetween. The primary transfer units 50Y, 50M, 50C and 50K apply primary transfer bias to toner images in respective colors on the photosensitive bodies 10Y, 10M, 10C and 10K after development at the contact positions with the photosensitive bodies 10Y, 10M, 10C and 10K as transfer positions. Then, the primary transfer units 50Y, 50M, 50C and 50K sequentially transfer the toner images overlapped with one another on the intermediate transfer body 40 to form a full-color toner image. The photosensitive body cleaning blade 15Y contacts the photosensitive body 10Y after primary transfer to scrape and collect the carrier remaining after the primary transfer. The collected carrier is temporarily stored in a yellow buffer tank 70Y, and then fed from the yellow buffer tank 70Y to a yellow concentration control tank 82Y.

A secondary transfer roller 61 of a secondary transfer unit 60 is disposed opposed to the belt driving roller 41 with the intermediate transfer body 40 interposed therebetween. In the secondary transfer unit 60, sheet material such as sheet, film, and fabric is fed and supplied along a sheet material feed path L at the same timing when a full-color toner image after color stacking or a monochrome toner image formed on the intermediate transfer body 40 reaches the transfer position of the secondary transfer unit 60. Then, the monochrome or full-color toner image is secondarily transferred on the sheet material by applying secondary transfer bias. A fixing unit (not shown) is disposed before the sheet material feed path L to fix the monochrome or full-color toner image transferred on the sheet material to a recording medium (sheet material) by fusing, and thereby final image formation on the sheet material ends. The intermediate transfer body cleaning blade 55 contacts the intermediate transfer body 40 after secondary transfer to collect remaining liquid developer and feed the collected liquid developer to a disposal tank 90.

The liquid developer collected by the photosensitive body squeeze roller 13Y disposed between the developing position on the photosensitive body 10Y corresponding to the developing roller 20Y and the primary transfer unit 50Y, and by the photosensitive body cleaning blade 15Y disposed downstream from the primary transfer unit SOY corresponding to the photosensitive body 10Y, is reused for each color.

The unit for reusing the collected liquid developer in yellow is now discussed as an example. The developer container 31Y containing the liquid developer is sectioned into a storage section 35Y and a collection section 36Y by a partition wall 34Y. The developer supply roller 32Y for supplying liquid developer to the developing roller 20Y is disposed in the storage section 35Y. The developing roller cleaning blade 21Y contacts the outer circumference of the developing roller 20Y at a position downstream from the developing nip for the photosensitive body 10Y to scrape and collect the liquid developer from the developing roller 20Y after development and feed the collected liquid developer to the collection section 36Y.

The liquid developer removed by the photosensitive body squeeze roller 13Y from the photosensitive body 10Y after development and prior to the primary transfer is scraped by the squeeze roller cleaning blade 14Y, and fed to the collection section 36Y of the developer container 31Y.

The liquid developer collected by the photosensitive body cleaning blade 15Y contacting the photosensitive body 10Y after the primary transfer is temporarily fed to the yellow buffer tank 70Y, and then sent from the yellow buffer tank 70Y to the yellow concentration control tank 82Y for reuse.

Components of the reuse unit are provided for each color. In case of yellow, for example, the reuse unit includes a yellow toner tank 81Y, a yellow concentration control tank 82Y, and a yellow storage tank. A common carrier tank 80 for all colors for storing new carrier is provided, and the concentration control tanks 82Y, 82M, 82C and 82K provided for each color are connected with the common carrier tank 80 via feed lines.

The collection section 36Y of the developing container 31Y communicates with the yellow concentration control tank 82Y as the concentration controller via the feed line. A concentration measuring device 120Y for measuring concentration, a liquid level measuring device 110Y for measuring liquid level, and a stirring unit are provided in the yellow concentration control tank 82Y.

The yellow concentration control tank 82Y receives new toner having a concentration of about 35% from the yellow toner tank 81Y and new carrier from the common carrier tank 80 via the feed line. The yellow concentration control tank 82Y communicates with the storage section 35Y of the developing container 31Y through a first feed line via a pump. The yellow concentration control tank 82Y also communicates with the liquid developer storage tank 83Y through the second feed line via a pump. The liquid developer storage tank 83Y communicates with the yellow concentration control tank through a third feed line via a pump.

Figure 3:
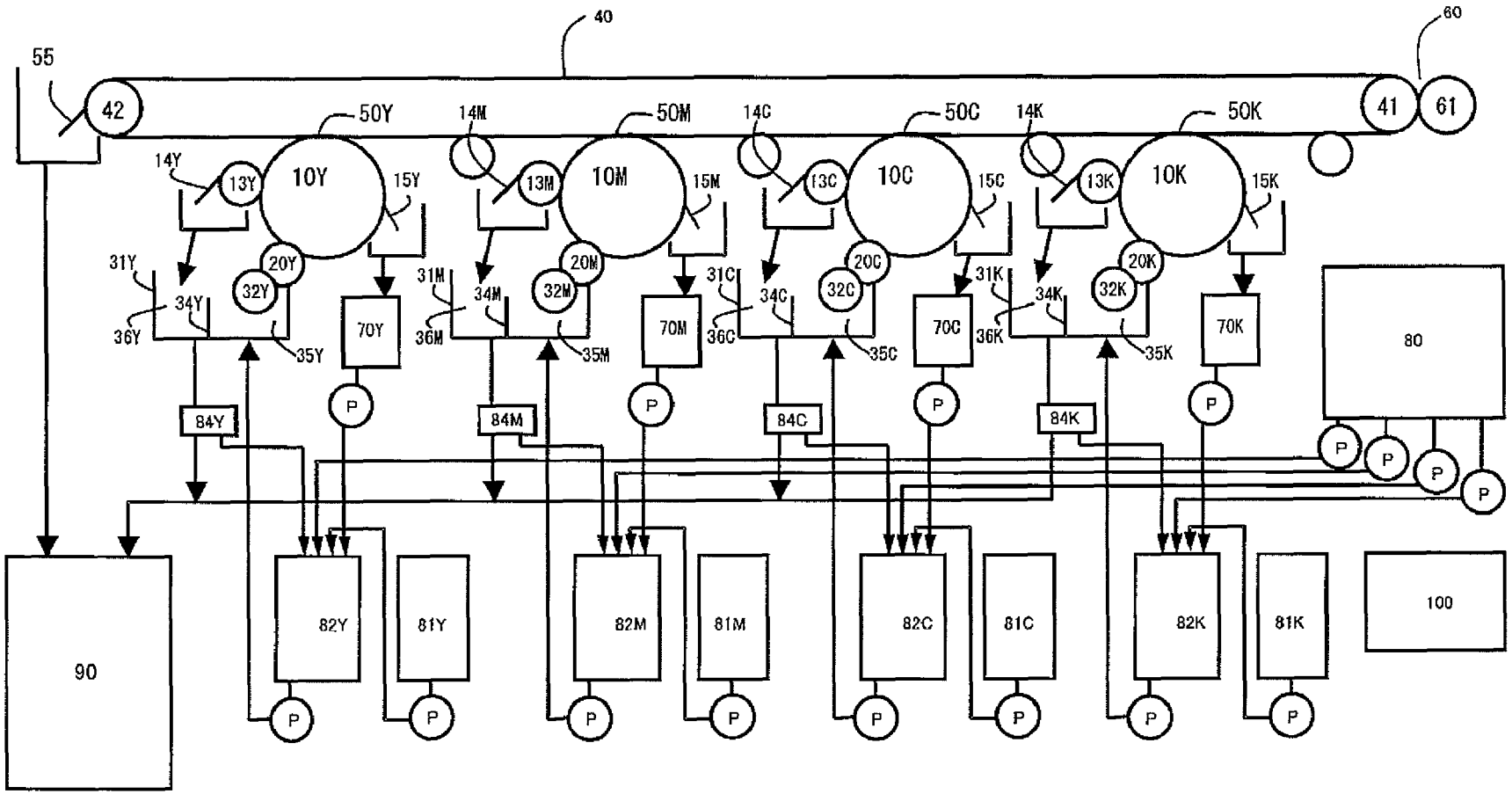
FIG. 3 illustrates an image forming apparatus that includes a liquid developer collecting system according to a second embodiment of the invention.
Figure 4:
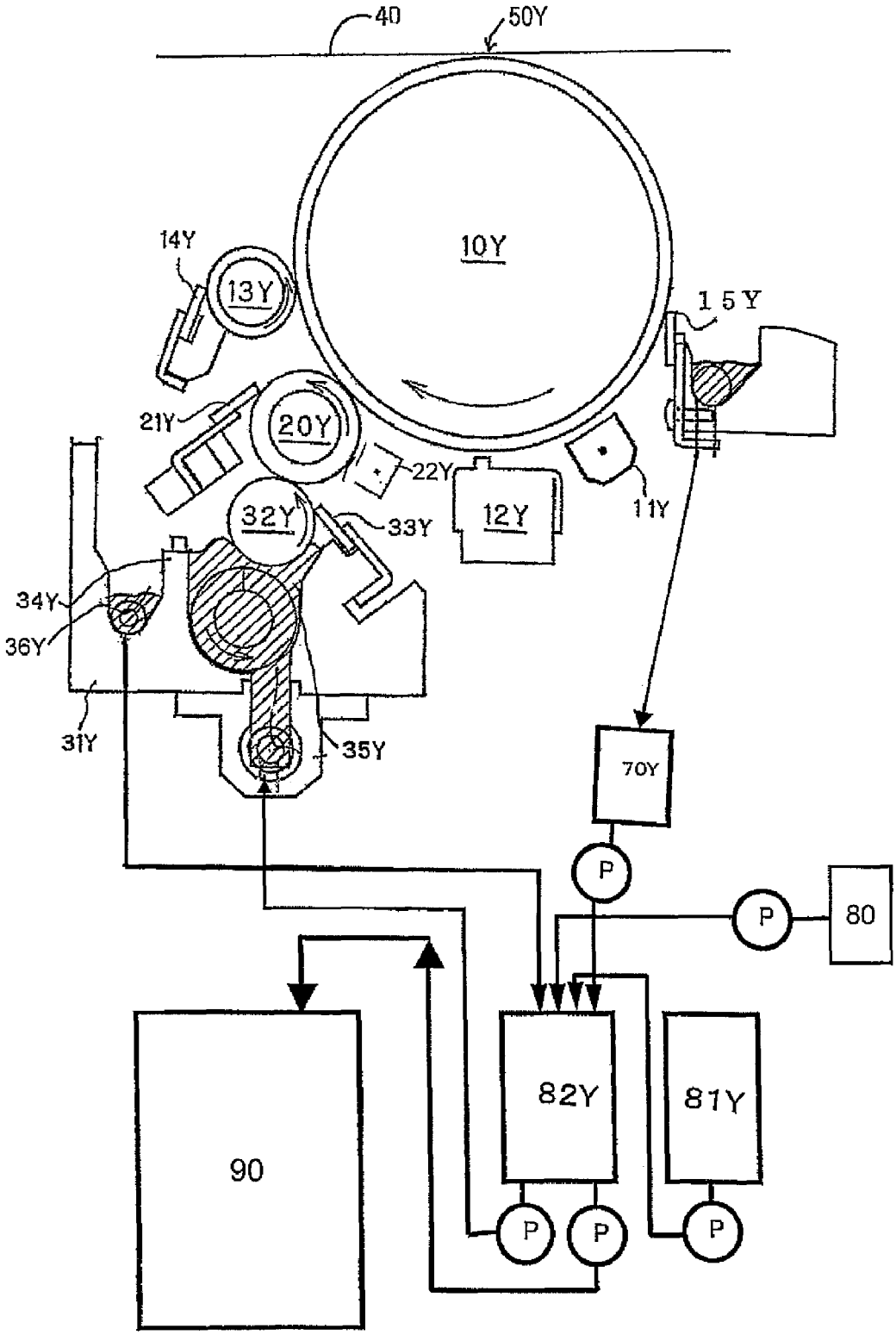
FIG. 4 is an enlarged view of a portion of the image forming apparatus of FIG. 3.

FIG. 3 illustrates the main structure elements of an image forming apparatus including a liquid developer collecting system according to a second embodiment of the invention. In FIG. 3, Y, M, C and K representing yellow (Y), magenta (M), cyan (C), and black (K) are added to each reference number given to the same structure element. FIG. 4 is an enlarged view of a portion of the image forming apparatus of FIG. 3 showing the structure of an image forming section, a developing unit, an intermediate transfer body, and the liquid developer collecting system for yellow (Y).

According to the image forming apparatus including the liquid developer collecting system in the second embodiment, the disposal tank 90 discards excessive liquid developer in the concentration control tank 82Y through the second feed line instead of the liquid developer storage tank 83Y communicating with the concentration control tank 82Y via the second feed line. Since the disposal tank 90 is common for each color, the required space can be reduced. Other structure is similar to that of the liquid developer collecting system in the first embodiment, and the same explanation is not repeated.

Figure 5:
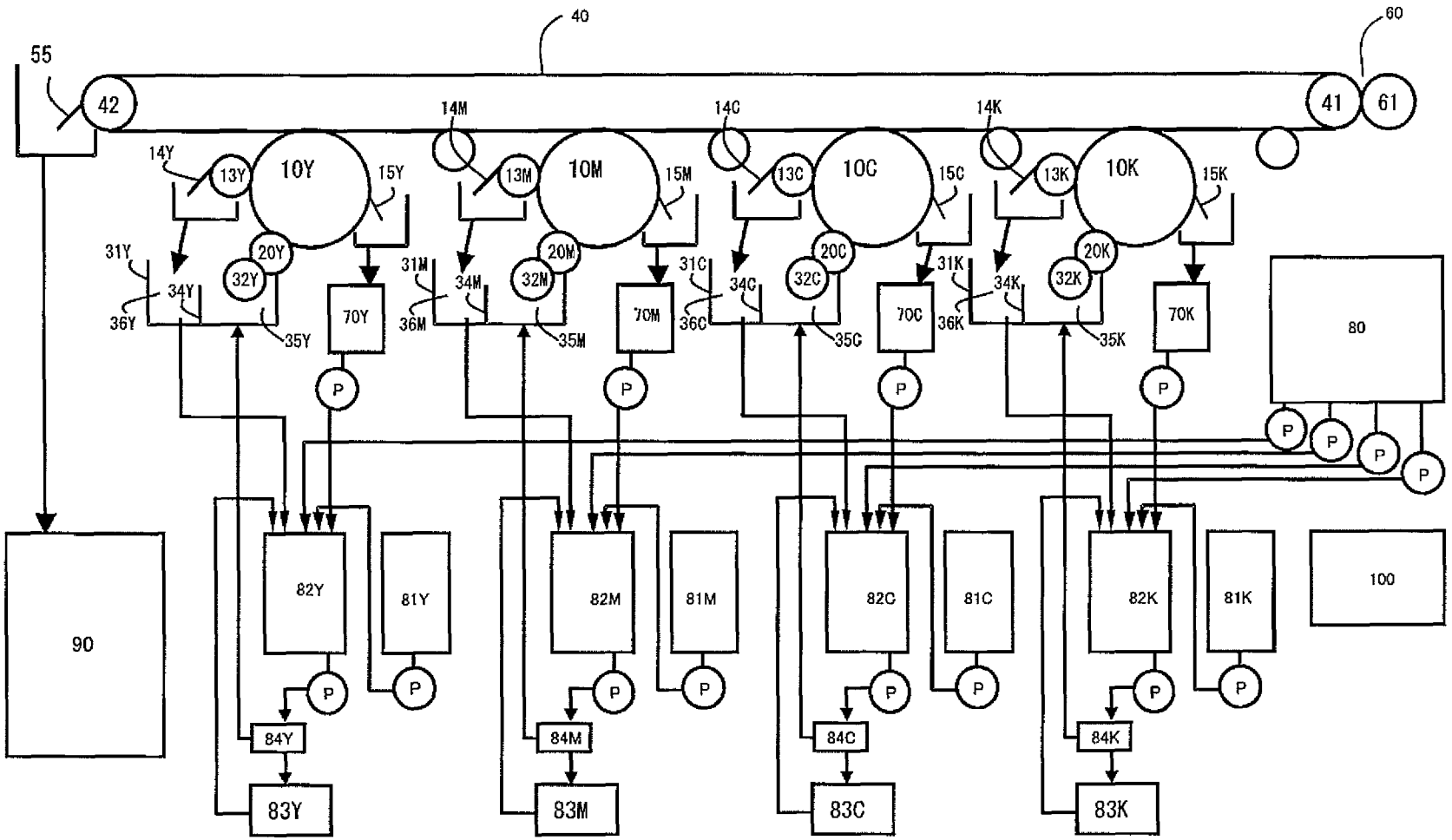
FIG. 5 illustrates an image forming apparatus that includes a liquid developer collecting system according to a third embodiment of the invention.
Figure 6:
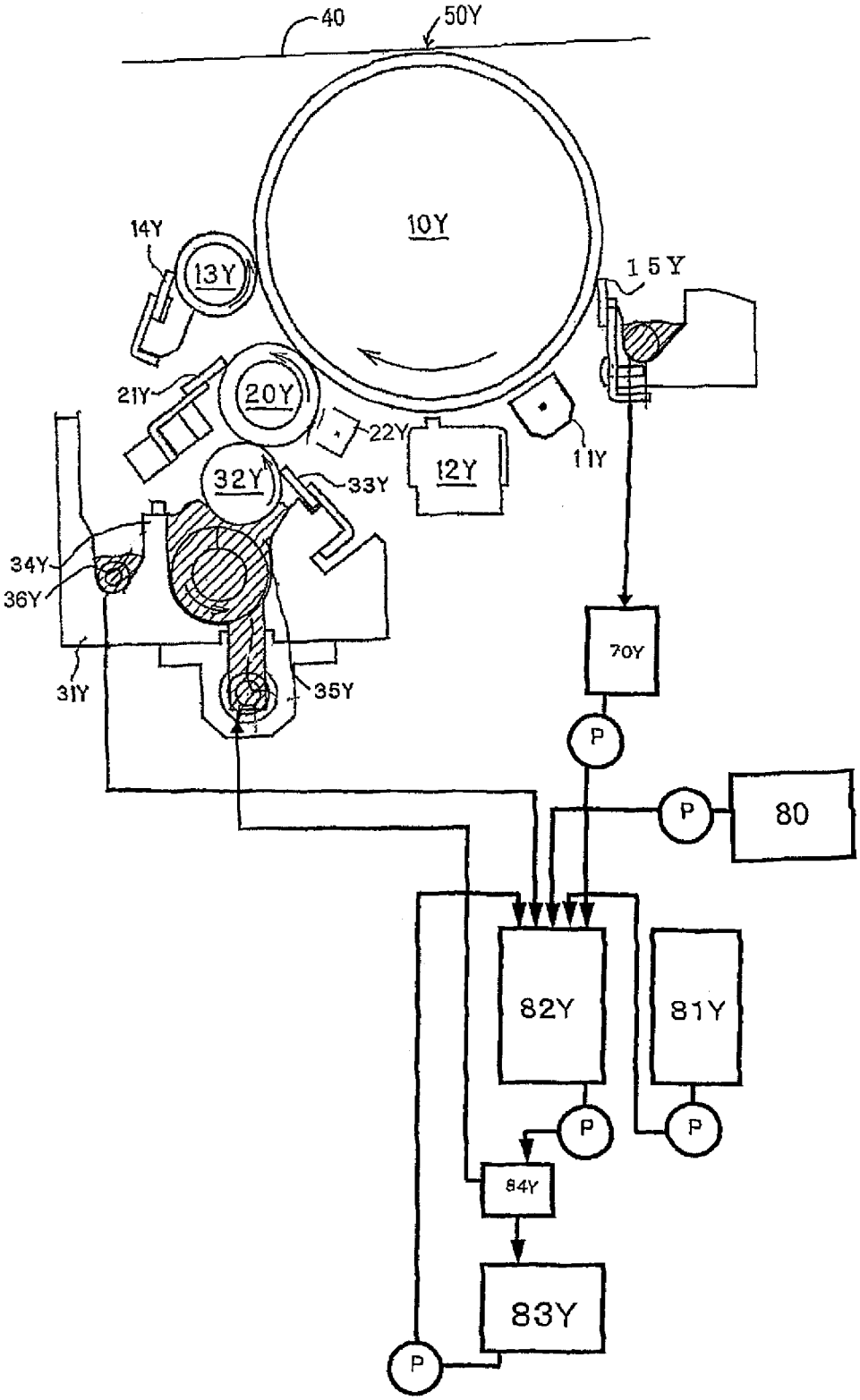
FIG. 6 is an enlarged view of a portion of the image forming apparatus of FIG. 5.

FIG. 5 illustrates the main structure elements of an image forming apparatus including a liquid developer collecting system according to a third embodiment of the invention. In FIG. 5, Y, M, C and K representing yellow (Y), magenta (M), cyan (C), and black (K) are added to each reference number given to the same structure element. FIG. 6 is an enlarged view of the image forming apparatus of FIG. 5 showing the structure of an image forming section, a developing unit, an intermediate transfer body, and the liquid developer collecting system for yellow (Y).

According to the image forming apparatus including the liquid developer collecting system in the third embodiment, a switching unit 84Y which switches between a case in which the liquid developer in the concentration control tank 82Y is fed to the storage section 35Y of the developing container 31Y via the first feed line and a case in which the liquid developer in the concentration control tank 82Y is fed to the liquid developer storage tank 83Y via the second feed line is disposed on the exit side of the concentration control tank 82Y. The switching unit is constituted by an electromagnetic switching valve or the like. The disposal tank 90 may be provided in place of the liquid developer storage tank 83Y. Other structure is similar to that of the liquid developer collecting system in the first embodiment, and the same explanation is not repeated.

Figure 7:
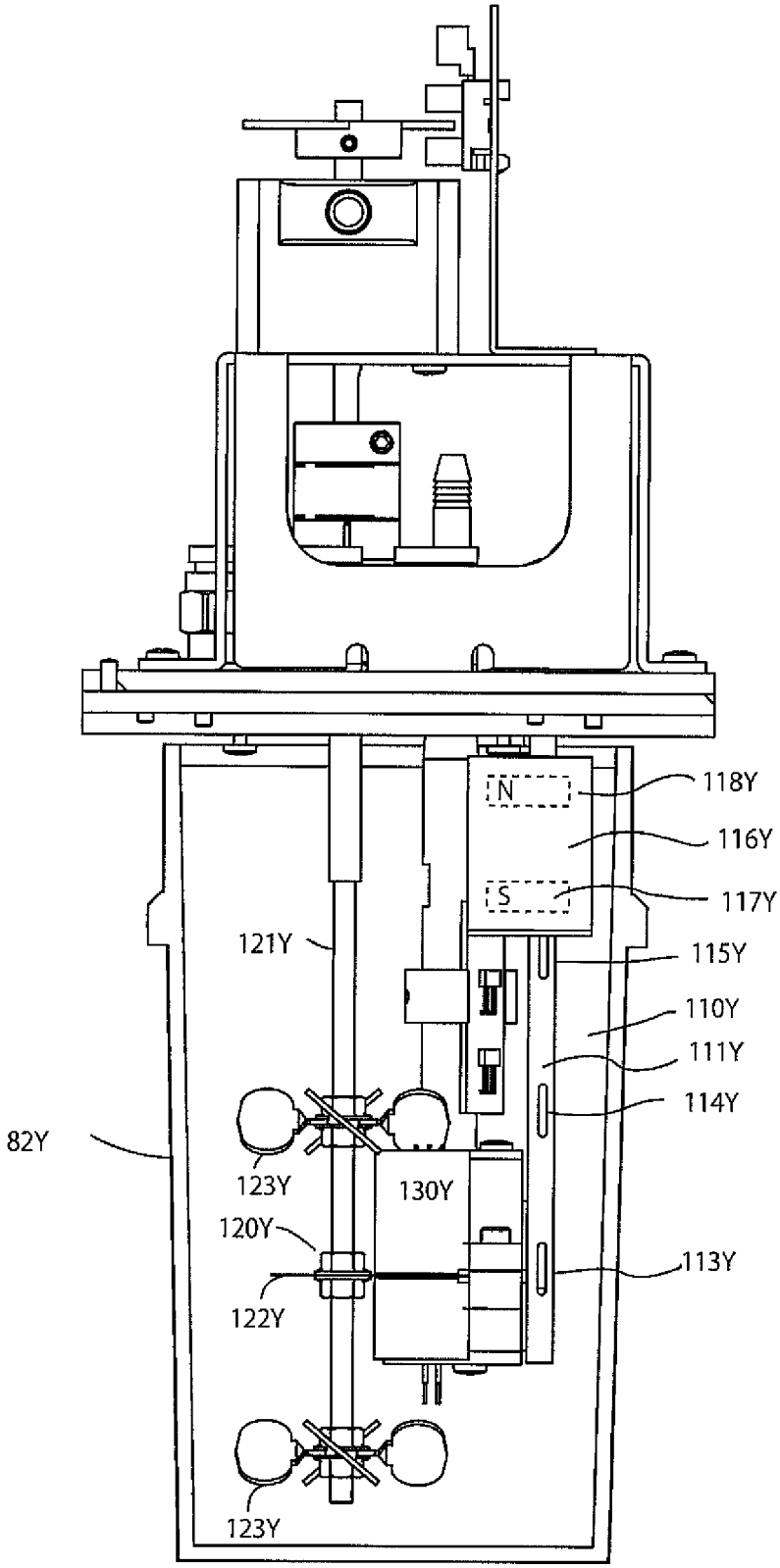
FIG. 7 illustrates a concentration control tank according to the invention.

The concentration and liquid level of the liquid developer are measured by a concentration sensor and a liquid level sensor disposed in the concentration control tank 82Y. A liquid amount measuring device 110Y as a liquid level sensor is first discussed. As illustrated in FIG. 7, the liquid amount measuring device 110Y has a float support member 111Y, a first hall device 113Y as an example of a proportional output type hall device, a second hall device 114Y, a third hall device 115Y, a float 116Y as an example of a float member, a first magnetic field generator 117Y, and a second magnetic field generator 118Y.

The float support member 111Y is constituted by a component supporting the float 116Y such that the float 116Y can shift from the surface of the liquid in the yellow concentration control tank 82Y approximately to the bottom below the liquid surface. The first hall device 113Y, the second hall device 114Y, and the third hall device 115Y are provided in this order from the lower position with a predetermined distance left between one another.

The first hall device 113Y, the second hall device 114Y, and the third hall device 115Y are constituted by proportional output type hall devices that vary output voltage relative to magnetic flux density. In this embodiment, each distance between the hall devices is set at 30 mm.

The float 116Y floats on the liquid surface and shifts with respect to the float support member 111Y according to the liquid surface position. The float 116Y has a first magnetic field generator 117Y at the lower position, and a second magnetic field generator 118Y at the upper position with a predetermined distance left therebetween. The first magnetic field generator 117Y and the second magnetic field generator 118Y shift such that these generators 117Y and 118Y come opposed to the respective hall devices 113Y, 114Y, and 115Y in accordance with the shift of the float 116Y. The first magnetic field generator 117Y and the second magnetic field generator 118Y are positioned such that N pole and S pole are located opposite for each magnetic field generator. In this embodiment, each of the magnetic field generators 117Y and 118Y has a diameter of 5 mm and a length of 6 mm, and generates a 4,000 Gauss magnetic field, and the respective magnetic field generators 117Y and 118Y are disposed with a distance of 20 mm left between each other.

The concentration measuring device 120Y has a stirring propeller shaft 121Y, a transparent propeller 122Y as an example of a shift member, a stirring propeller 123Y as an example of a stirring member, and a concentration measuring unit 130Y. The stirring propeller shaft 121Y is a shaft on which the transparent propeller 122Y and the stirring propeller 123Y are coaxially provided, and rotated by a motor.

Figure 8:
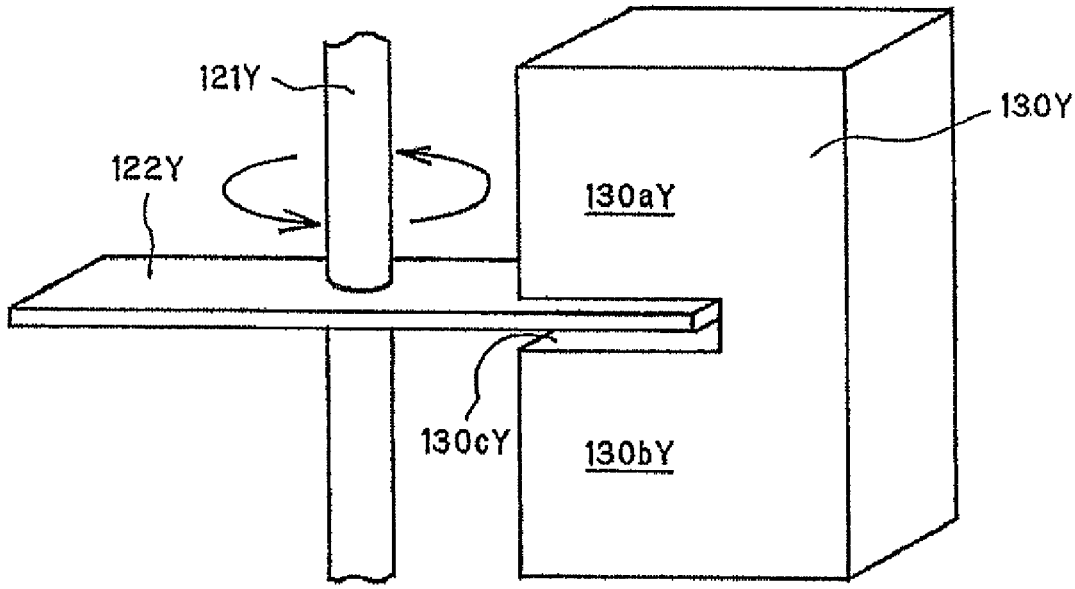
FIG. 8 illustrates a concentration measuring unit and a transparent propeller according to the invention.

A concentration detection method using the concentration measuring unit 130Y and the transparent propeller 122Y is now explained. As illustrated in FIG. 8, the transparent propeller 122Y is a rectangular or other flat-plate-shaped rotatable component that is supported by a stirring propeller shaft 121Y, and intermittently passes through a clearance 130*c*Y formed between a first member 130*a*Y and a second member 130*b*Y of the concentration measuring unit 130Y. The first member 130*a*Y and the second member 130*b*Y are movable to vary the length of the clearance 130*c*Y. The length of the clearance 130*c*Y can be varied according to the color of the liquid developer.

Figure 9A:
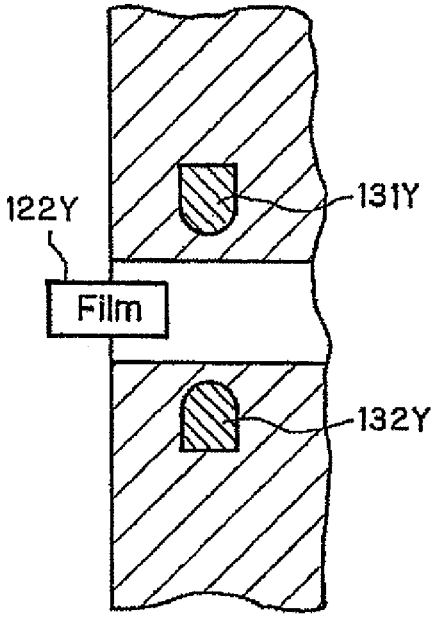
FIGS. 9A and 9B are cross sectional views of a transmission type concentration measuring unit according to the invention.
Figure 9B:
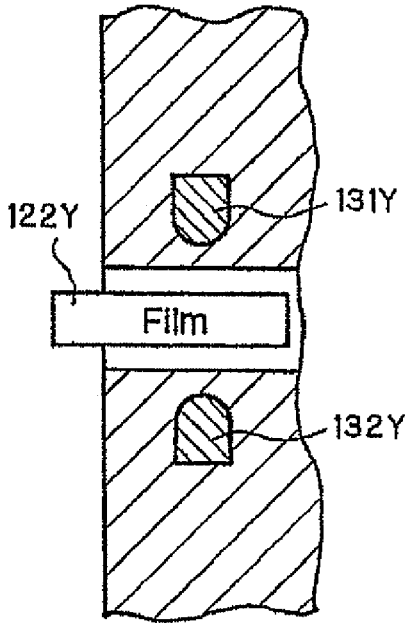

According to the transmission type concentration measuring unit 130Y shown in FIGS. 9A and 9B, a light emission LED 131Y and a concentration measurement light receiving element 132Y as an example of a concentration measuring member are disposed opposed to each other with the clearance 130*c*Y interposed therebetween. An emission light intensity measurement light receiving element 133Y is disposed on the light emission LED 131Y side.

Figure 10:
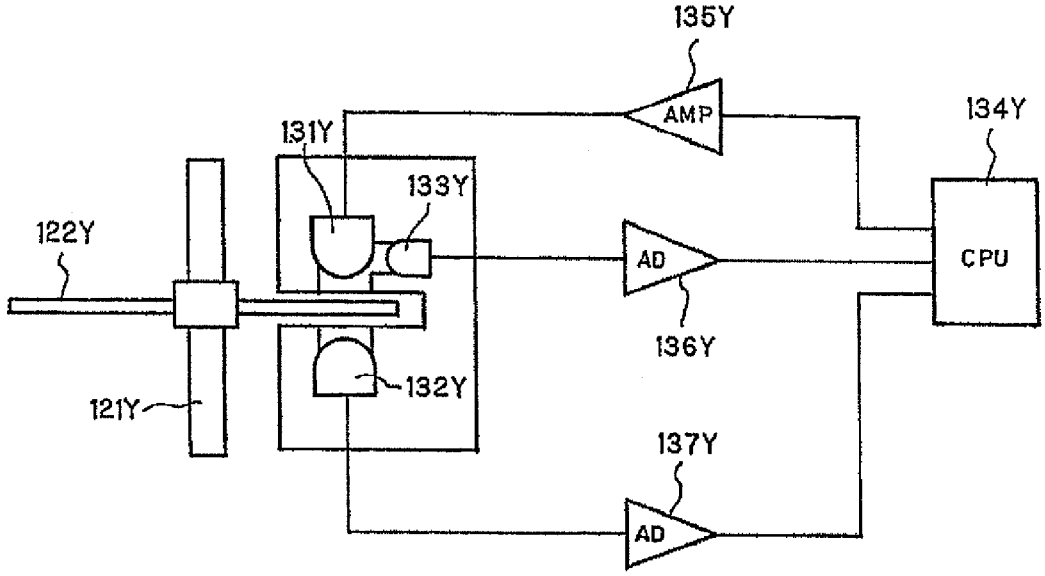
FIG. 10 is a circuit diagram illustrating a configuration of the transmission type concentration measuring unit according to the invention.

As illustrated in FIG. 10, the light emission LED 131Y, the concentration measurement light receiving element 132Y, and the emission light intensity measurement light receiving element 133Y are connected with a CPU 134Y. The light emission LED 131Y is connected with the CPU 134Y via an amplifier 135Y, the concentration measurement light receiving element 132Y is connected with the CPU 134Y via a first A/D converter 136Y, and the emission light intensity measurement light receiving element 133Y is connected with the CPU 134Y via a second A/D converter 137.

Figure 11:
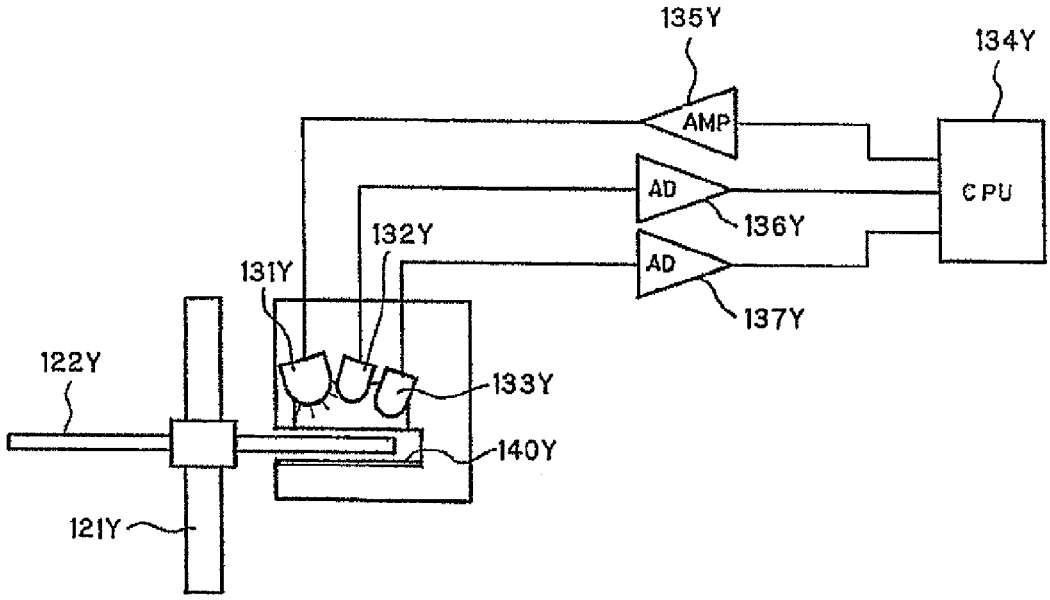
FIG. 11 is a circuit diagram illustrating a configuration of a reflective type concentration measuring unit according to the invention.

According to the reflection type concentration measuring unit 130Y shown in FIG. 11, the light emission LED 131Y, the concentration measurement light receiving element 132Y, and the emission light intensity measurement light receiving element 133Y are disposed on one side of the clearance 130*c*Y. A reflection film 140Y is provided on the other side of the clearance 130*c*Y.

In this structure, light emitted from the light emission LED 131Y has an optical path that passes the liquid developer on the light emission LED 131Y side from the transparent propeller 122Y, the transparent propeller 122Y, and the liquid developer on the reflection film 140Y side. Then, the light is reflected by the reflection film 140Y, and passes the liquid developer on the reflection film 140Y side, the transparent propeller 122Y, and the liquid developer on the concentration measurement light receiving element 132Y side from the transparent propeller 122Y to be received by the concentration measurement light receiving element 132Y. The light emitted from the light emission LED 131Y also has an optical path that passes the liquid developer on the light emission LED 131Y from the transparent propeller 122Y to be received by the emission light intensity measurement light receiving element 133Y.

The light emission LED 131Y, the concentration measurement light receiving element 132Y, and the emission light intensity measurement light receiving element 133Y are connected with the CPU 134Y. The light emission LED 131Y is connected with the CPU 134Y via the amplifier 135Y, the concentration measurement light receiving element 132Y is connected with the CPU 134Y via the first A/D converter 136Y, and the emission light intensity measurement light receiving element 133Y is connected with the CPU 134Y via the second A/D converter 137Y.

The solid concentration of the liquid developer collected by the developing roller cleaning blade 21Y from the developing roller 20Y after development and fed by the collection section 36Y varies according to image data. More specifically, when the image data corresponds to full-tone, many solid particles are shifted to the photosensitive body and consumed. Thus, the solid concentration of the collected liquid developer is low. When the image data corresponds to half-tone, by contrast, only a small amount of solid particles are shifted to the photosensitive body. In this case, the solid concentration of the collected liquid developer changes little.

The liquid developer scraped by the squeeze roller cleaning blade 14Y from the photosensitive body squeeze roller 13Y that contacts the photosensitive body 10Y after development and prior to the primary transfer and removes the remaining liquid developer to be fed to the collection section 36Y has a large proportion of carrier and a low solid concentration.

The liquid developer collected by the photosensitive body cleaning blade 15Y contacting the photosensitive body 10Y after primary transfer and temporarily fed to the yellow buffer tank 70Y has a large proportion of carrier and a low solid concentration.

The amount of the liquid developer supplied to the storage section 35Y of the developer container 31Y is set slightly larger than the liquid developer consumption amount required for development. Thus, the liquid developer supplied to the storage section 35Y overflows the partition wall 34Y toward the collection section 36Y. The concentration of the liquid developer overflowing from the storage section 35Y is adjusted to the target concentration, and thus the concentration does not change.

Accordingly, the concentration of the liquid developer collected and fed to the concentration control tank 82Y is lower than the initial solid concentration due to consumption of the toner. As the liquid developer is collected and reused, the solid concentration of the liquid developer collected from the developing roller 20Y after development by using the developing roller cleaning blade 21Y greatly varies.

The capacity of the concentration control tank 82Y for adjusting the collected liquid developer to the target concentration for reuse needs to be small since the concentration control tank is equipped for each color for prevention of color mixture. For example, when new toner having a solid concentration of 35% and contained in the toner tank 81Y is supplied and stirred to adjust the solid concentration of 17% of the liquid developer collected and contained in the concentration control tank 82Y to the target solid concentration of 20%, the concentration control tank 82Y needs to have a remaining capacity to which the new toner is supplied.

However, when the amount of the liquid developer fed from the collection section 36Y of the developer container 31Y is large with no remaining capacity of the concentration control tank 82Y, it is difficult to adjust the concentration to the target value.

For efficiently controlling the concentration at the concentration control tank 82Y, the liquid developer storage tank 83Y or the disposal tank 90 for storing the collected liquid developer is provided separately from the concentration control tank 82Y. A process flow performed according to the liquid level and concentration of the concentration control tank 82Y is now explained.

Case 1

The liquid level is measured by the liquid amount measuring device 110Y contained in the concentration control tank 82Y. When the liquid level in the concentration control tank 82Y is an upper predetermined value of 118 mm (reference: bottom of concentration control tank 82Y) or higher, the liquid developer in the concentration control tank 82Y is fed to the liquid developer storage tank 83Y or the disposal tank 90 as a separate tank to adjust the liquid level of the liquid developer in the concentration control tank 82Y to a lower predetermined value.

Case 2

When the liquid level in the concentration control tank 82Y is the lower predetermined value of 100 mm or lower with the concentration of the liquid developer in the concentration control tank 82Y equal to or higher than the use allowable value of 19%, the liquid developer of 50 ml is fed from the liquid developer storage tank 83Y to the concentration control tank 82Y via the third feed line. The liquid feed speed by the pump from the liquid developer storage tank 83Y to the concentration control tank 82Y is 80 ml/min. Thus, the pump is driven for 37.5 seconds.

Case 3

When the liquid level of the concentration control tank 82Y is a first predetermined value (liquid developer amount: 600 ml) or higher with the solid concentration equal to or lower than a predetermined value as the use allowable value which is lower than the target concentration, the necessary supply toner amount sufficient for adjusting the solid concentration to the target concentration is calculated. The volume of the calculated necessary supply toner and the liquid developer having the predetermined volume in the concentration control tank 82Y are fed to the liquid developer storage tank 83Y via the second feed line.

For example, assuming that:

current liquid developer amount in concentration control tank 82Y tank: vol_crnt (600 ml)

current toner concentration in stirring tank: Dens_crnt (17%)

toner concentration of supply developer: Dens_sd (35%)

target toner concentration: Dens_tgt (20%)

necessary supply developer amount: Vol_x, $$\text{Dens_tgt}=[(\text{Vol_crnt}-\text{Vol_}x)\times\text{Dens_crnt}+\text{Vol_}x\times\text{Dens_sd}]/\text{Vol_crnt}],$$

which is changed into the following equation, $$\begin{aligned}\text{Vol_x} &= \text{Vol_crnt}\times(\text{Dens_tgt}-\text{Dens_crnt})/(\text{Dens_sd}-\text{Dens_crnt})\\ &= 600\times(0.2-0.17)/(0.35-0.17)\\ &= 100\text{ ml.}\end{aligned}$$

The amount to be fed from the concentration control tank 82Y to the liquid developer storage tank 83Y or the disposal tank 90 as a separate tank is 100+10=110 ml, and the liquid feed speed by the pump from the concentration control tank 82Y to the liquid developer storage tank 83Y or the disposal tank 90 as a separate tank is 80 ml/min. Thus, the pump is driven for 82.5 seconds. Also, new liquid developer of 100 ml is fed from the toner tank 81Y to the concentration control tank 82Y. In this case, the concentration in the concentration control tank 82Y becomes 20%.

The amount of the supply developer to be fed by the concentration measuring device 120Y may be finely adjusted. Alternatively, more liquid developer such as the necessary supply developer plus 100 ml may be fed from the concentration control tank 82Y to the liquid developer storage tank 83Y or the disposal tank 90 as a separate tank. It is also possible to judge whether the liquid amount is 110 ml or not by using the liquid measuring device 110Y contained in the concentration control tank 82Y. While the toner concentration is calculated by volume rate in this embodiment, the weight rate can be calculated by conversion based on the volume and density.

Figure 12:
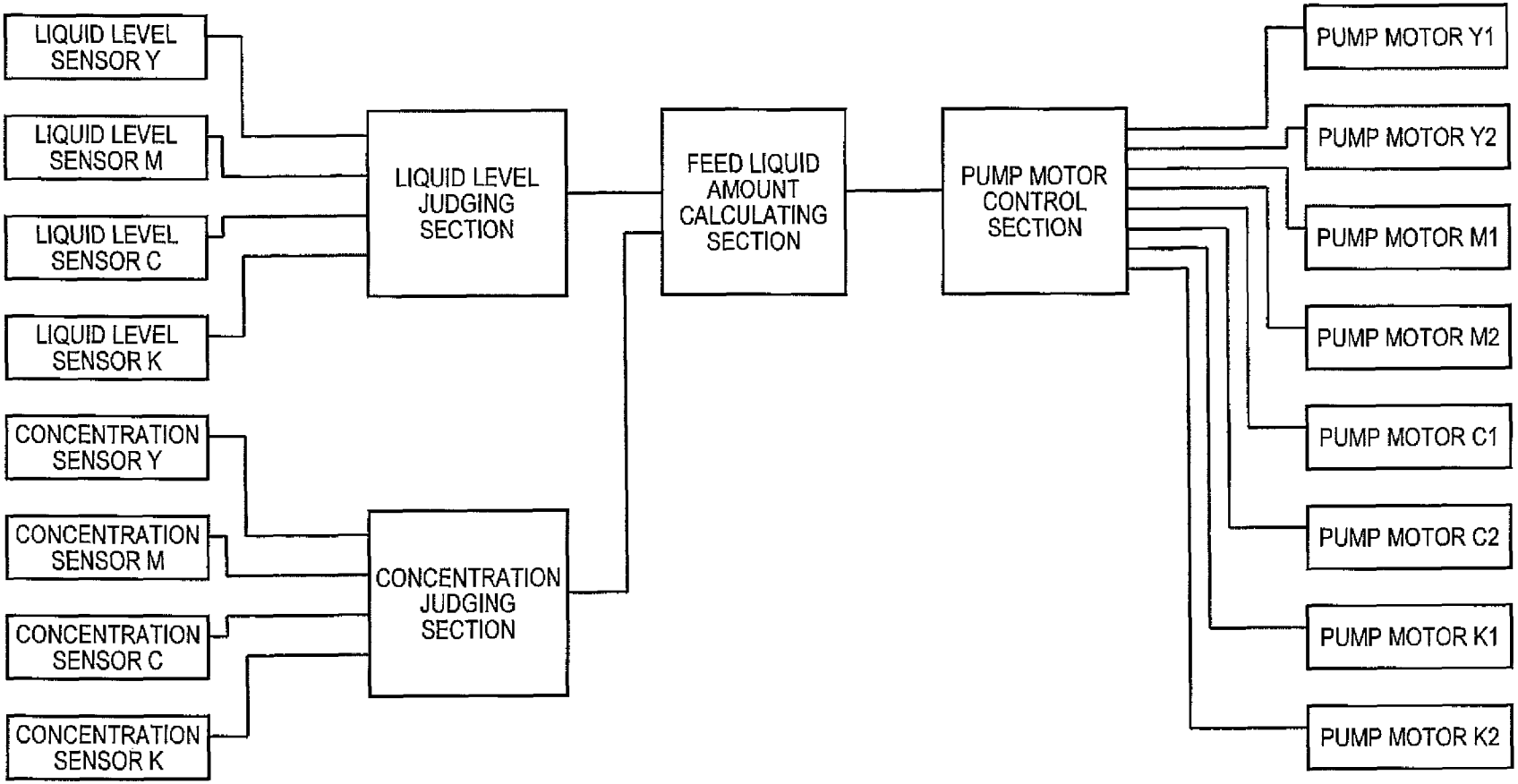
FIG. 12 is a block diagram of an embodiment of the invention.

FIG. 12 illustrates a condition in which: the liquid level and concentration data measured by the liquid amount measuring devices 110Y, M, C, and K and the concentration measuring devices 120Y, M, C, and K are transmitted to a liquid level judging section and a concentration judging section; the feed liquid amount is calculated by a feed liquid amount calculating section based on the data received from the liquid level judging section and the concentration judging section; the data on the calculated feed liquid amount is transmitted to a pump motor control section; and the concentration control of the collected liquid developer can be efficiently performed in the concentration control tanks 82Y, M, C, and K while controlling the driving of the pump motor under the control of the pump motor control section.

Figure 13:
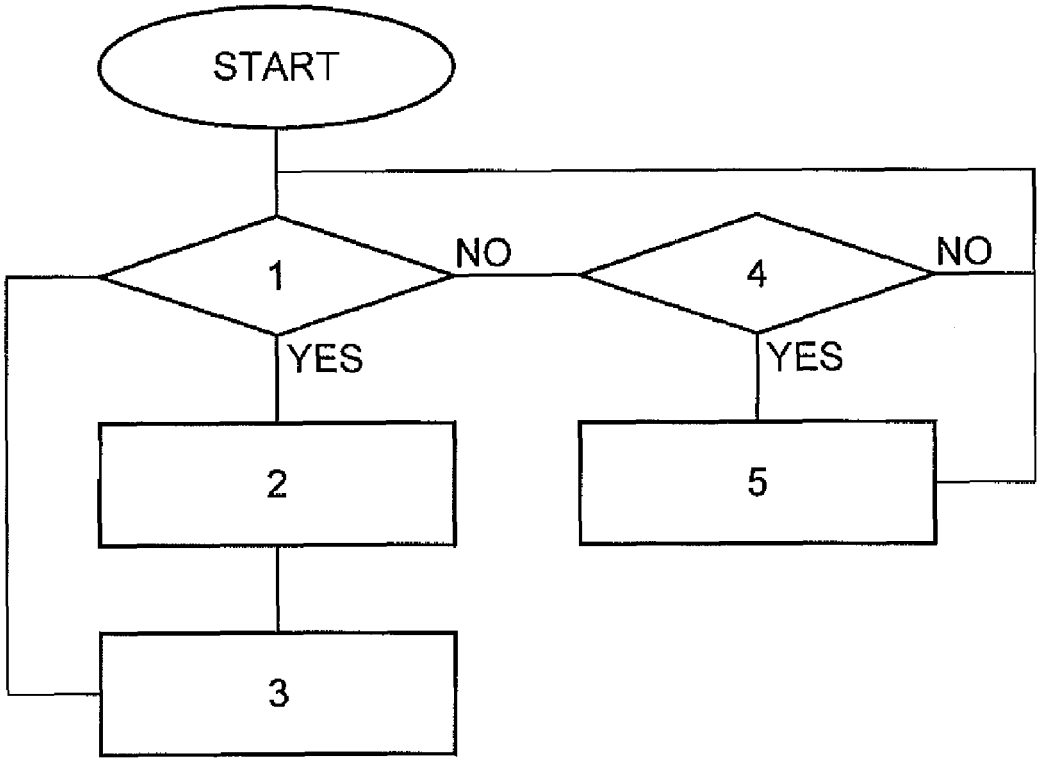
FIG. 13 illustrates a process flow of the liquid developer collecting system according to the invention.

FIG. 13 shows a process flow of the liquid developer collecting system according to the embodiments of the invention. Initially, it is judged whether the liquid level of the concentration control tank 82Y is equal to or higher than a first predetermined value in step (1). When Yes, the process shifts to step (2). When No, the process shifts to step (4). In step (2), the amount of the liquid developer to be fed from the concentration control tank 82Y to the liquid developer storage tank 83Y or the disposal tank 90 as a separate tank is calculated as discussed in Case 1, and the process goes to step (3). In step (3), the calculated amount of liquid developer is fed from the concentration control tank 82Y to the liquid developer storage tank 83Y or the disposal tank 90. In step (4), it is judged whether the liquid level in the concentration control tank 82Y is equal to or lower than a second predetermined value which is lower than the first predetermined value, and whether the solid concentration is equal to or higher than a predetermined value. When Yes, the process shifts to step (5) When No, the process returns to step (1). In step (5), the liquid developer is supplied from the liquid developer storage tank 83Y to the concentration control tank 62Y via the third feed line in the manner shown in Case 2, and then the process returns to step (1).

Accordingly, the liquid developer collecting system according to the embodiments of the invention controls the concentration of liquid developer efficiently collected by a simple structure. Moreover, the space required for respective devices is reduced, which contributes to size reduction of the image forming apparatus.

What is claimed is:

1. A liquid developer collecting system, comprising:

a developing unit that has a developing roller that carries liquid developer;

a developing roller cleaning unit that collects the liquid developer on the developing roller;

a collection section that stores the liquid developer collected by the developing roller cleaning unit;

a concentration control unit that controls the concentration of the liquid developer;

a first feed unit that feeds the liquid developer in the concentration control unit to the developing unit;

a developer storage unit that stores the liquid developer;

a second feed unit that feeds the liquid developer in the concentration control unit to the developer storage unit; and a third feed unit that feeds the liquid developer in the developer storage unit to the concentration control unit.

2. The liquid developer collecting system according to claim 1, further comprising a switching unit that switches between the first feed unit and the second feed unit for feeding the liquid developer in the concentration control unit.

3. The liquid developer collecting system according to claim 1, wherein:

the developing unit has a storage section that supplies liquid developer to the developing roller and the collection section, the storage section and the collection section being sectioned by a partition wall; and the liquid developer overflows the partition wall from the storage section into the collection section.

4. The liquid developer collecting system according to claim 1, further comprising:

a photosensitive body;

a squeeze unit that squeezes an image developed by the developing roller and that collects liquid developer on the photosensitive body; and a fourth feed unit that feeds the liquid developer collected by the squeeze unit to the concentration control unit.

5. The liquid developer collecting system according to claim 1, further comprising:

a liquid level sensor that measures a liquid level in the concentration control unit;

a concentration sensor that measures the concentration of the liquid developer in the concentration control unit; and a calculating unit that calculates the feed amount of the liquid developer from the concentration control unit to the developer storage unit based on measurement data of the concentration sensor and the liquid level sensor.

6. An image forming apparatus, comprising:

a photosensitive body that carries an electrostatic latent image;

a developing unit that develops the electrostatic latent image by liquid developer and that has a developing roller, a developing roller cleaning unit that collects the liquid developer on the developing roller and a collection section that stores the liquid developer collected by the developing roller cleaning unit;

a transfer unit that transfers an image developed on the photosensitive body;

a concentration control unit that controls the concentration of the liquid developer;

a first feed unit that feeds the liquid developer in the concentration control unit to the developing unit;

a developer storage unit that stores the liquid developer; and a second feed unit that feeds the liquid developer in the concentration control unit to the developer storage unit; and a third feed unit that feeds the liquid developer in the developer storage unit to the concentration control unit.

7. An image forming apparatus according to claim 6, further comprising a switching unit that switches between the first feed unit and the second feed unit for feeding the liquid developer in the concentration control unit.

8. The image forming apparatus according to claim 6, wherein:

the developing unit has a storage section that supplies liquid developer to the developing roller, the storage section and the collection section being sectioned by a partition wall; and the liquid developer overflows the partition wall from the storage section into the collection section.

9. The image forming apparatus according to claim 6, further comprising:

a squeeze unit that squeezes the image on the photosensitive body and that collects liquid developer on the photosensitive body; and a fourth feed unit that feeds the liquid developer collected by the squeeze unit to the concentration control unit.

10. The image forming apparatus according to claim 6, further comprising:

a liquid level sensor that measures a liquid level in the concentration control unit;

a concentration sensor that measures the concentration of the liquid developer in the concentration control unit; and a calculating unit that calculates the feed amount of the liquid developer from the concentration control unit to the developer storage unit based on measurement data of the concentration sensor and the liquid level sensor.

* * * * *